US008240182B2

(12) United States Patent
Huang et al.

(10) Patent No.: US 8,240,182 B2
(45) Date of Patent: Aug. 14, 2012

(54) STAMPING DIE

(75) Inventors: Kuo-Jung Huang, Taipei Hsien (TW); Shu-Wei Zhou, Shenzhen (CN); Fu-Shun Huang, Taipei Hsien (TW); Jian Luo, Shenzhen (CN); Yi-Hua Liu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 991 days.

(21) Appl. No.: 12/238,405

(22) Filed: Sep. 25, 2008

(65) Prior Publication Data

US 2009/0266134 A1 Oct. 29, 2009

(30) Foreign Application Priority Data

Apr. 28, 2008 (CN) ..... 2008 1 0301371

(51) Int. Cl.
*B21D 31/02* (2006.01)
*B21J 13/02* (2006.01)

(52) U.S. Cl. ..... 72/327; 72/478

(58) Field of Classification Search ..... 72/325, 72/327–329, 467, 478; 83/138, 143, 542, 83/582, 698.91
See application file for complete search history.

(56) References Cited

U.S. PATENT DOCUMENTS

| | | | | |
|---|---|---|---|---|
| 3,100,411 | A * | 8/1963 | Airlie | 83/138 |
| 4,109,501 | A * | 8/1978 | Kozima | 72/327 |
| 5,979,277 | A * | 11/1999 | Kitsuda et al. | 72/327 |
| 2005/0103088 | A1 | 5/2005 | Yamanaka et al. | |
| 2005/0217343 | A1 * | 10/2005 | Tomita | 72/325 |

FOREIGN PATENT DOCUMENTS

| | | |
|---|---|---|
| JP | 52070145 U | 5/1977 |
| TW | 337217 | 7/1998 |
| TW | I222905 | 11/2004 |
| TW | M319841 | 10/2007 |

* cited by examiner

*Primary Examiner* — Teresa M Ekiert
(74) *Attorney, Agent, or Firm* — Altis Law Group, Inc.

(57) ABSTRACT

A stamping die (20) includes a base set (21), a punch (241, 242, 243, 244, 245) detachably assembled on the base set, and a stripper plate (23) disposed on top of the base set. The stripper plate defines a through hole (231) through which the punch passes, and at least one elastic member (28) is disposed between the base set and the stripper plate. The stamping die can punch different shaped holes by means of changing the punch.

12 Claims, 8 Drawing Sheets

STAMPING DIE

BACKGROUND OF THE INVENTION

1. Field of the Invention

The present invention relates to die stamping and, more particularly, to a stamping die used in a punch press.

2. Discussion of the Related Art

Various methods are used in conventional production of metal parts. One such method is stamping, in which stock material, typically a metal sheet, is fed into a punch press and a metal part, such as a hole, a notch, an L-shaped holder is formed. The stamping die parties a critical component of the punch press system.

Referring to FIG. 8, a typical stamping die 10 includes a base set 11 and a stripper plate 12. The base set 11 has a punch 111 formed on the center of the base set 11, and the punch 111 is integrally formed with the base set 11. The stripper plate 12 is disposed on the base set 11. A through hole 121 is defined in the center of the stripper plate 12 corresponding to the punch 111, and the punch 111 is configured to pass through the through hole 121. A plurality of helical springs 112 are disposed between the base set 11 and the stripper plate 12, acting as buffer. When the base set 11 is moved upwards by external force, the helical springs 112 compress and impel the stripper plate 12 to contact a workpiece firmly, such that the punch 111 passes through the stripper plate 12 and punches a hole in the workpiece.

Because the punch 111 is integrally formed with the base set 10, punching is restricted to a single shape. When a new product requires a hole of different shape, a new stamping die 10 must be pre-fabricated correspondingly. The conventional stamping die 10 thus presents disadvantages, such as long production cycle and high production cost. In addition, over time, the punch 111 is subject to wear, requiring replacement of the entire stamping die 10.

What is needed, therefore, is a stamping die that overcomes the described limitations.

SUMMARY

A stamping die includes a base set, a punch disposed in the center of the stamping die, a stripper plate disposed on top of the base set, and a guide hole defined in the stripper plate through which the punch passes, a clamping plate disposed between the base set and the stripper plate, and at least one elastic member disposed between the clamping plate and the stripper plate. The punch includes at least one flange disposed on a side thereof, the clamping plate defines a mounting hole in a surface through which the punch passes, and the at least one flange of the punch is retained on the bottom of the clamping plate; the clamping plate is detachably fixed on the base set, thus the at least one flange of the punch is clamped between the clamping plate and the base set, such that the punch is detachably assembled on the base set.

Another stamping die includes a base set, a punch detachably assembled on the base set, a stripper plate disposed on top of the base set, the stripper plate defining a through hole through which the punch passes and at least one elastic member disposed between the base set and the stripper plate.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of the present stamping die. Moreover, in the drawings, like reference numerals designate corresponding parts throughout the several views.

DETAILED DESCRIPTION OF THE EMBODIMENTS

Reference will now be made to the drawings to describe preferred embodiments of the present stamping die, in detail. The stamping die is used in a punch press as a lower die.

Figure 1:
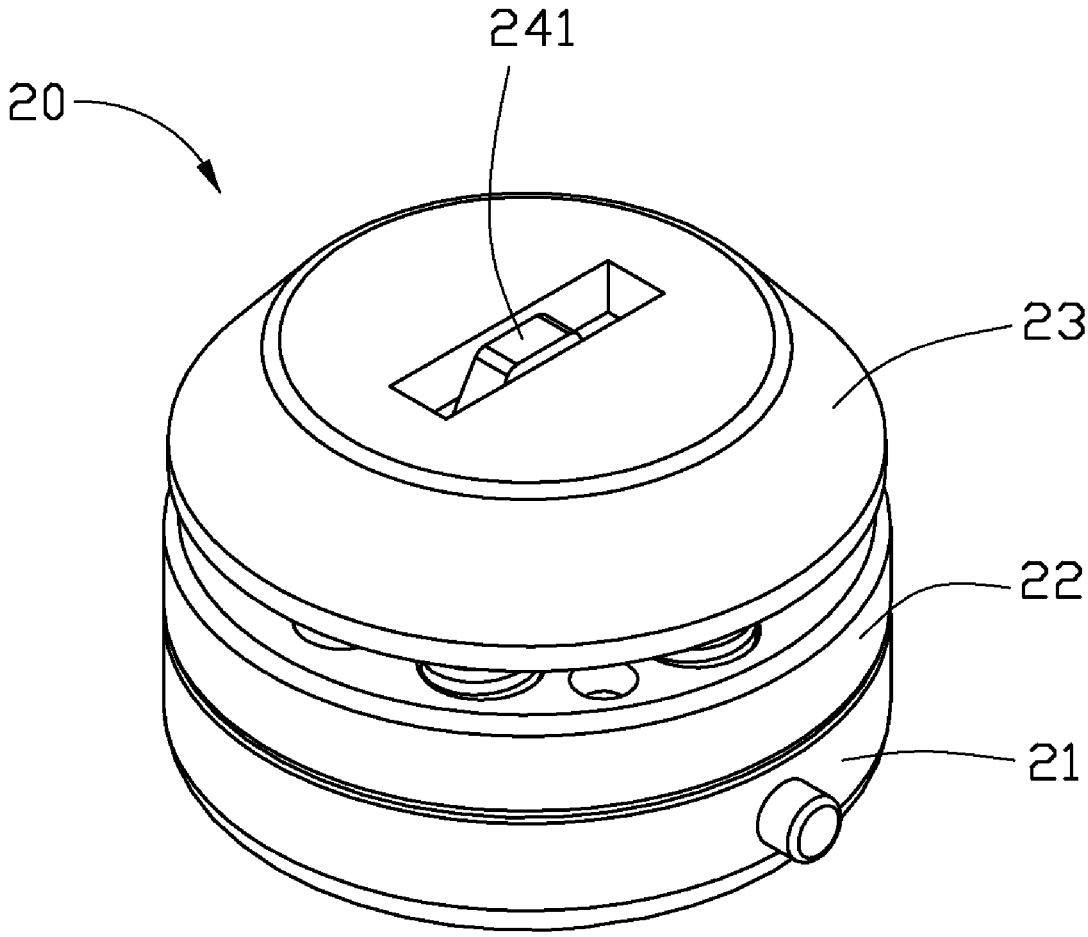
FIG. 1 is an assembled, isometric view of a stamping die of the present invention in accordance with one embodiment.

Referring to FIG. 1, a stamping die 20 in accordance with the disclosure is shown. The stamping die 20 includes a base set 21, a clamping plate 22 disposed on the base set 21, a stripper plate 23 resiliently disposed on the clamping plate 22, and a first punch 241 disposed in the center of the stamping die 20.

Figure 2:
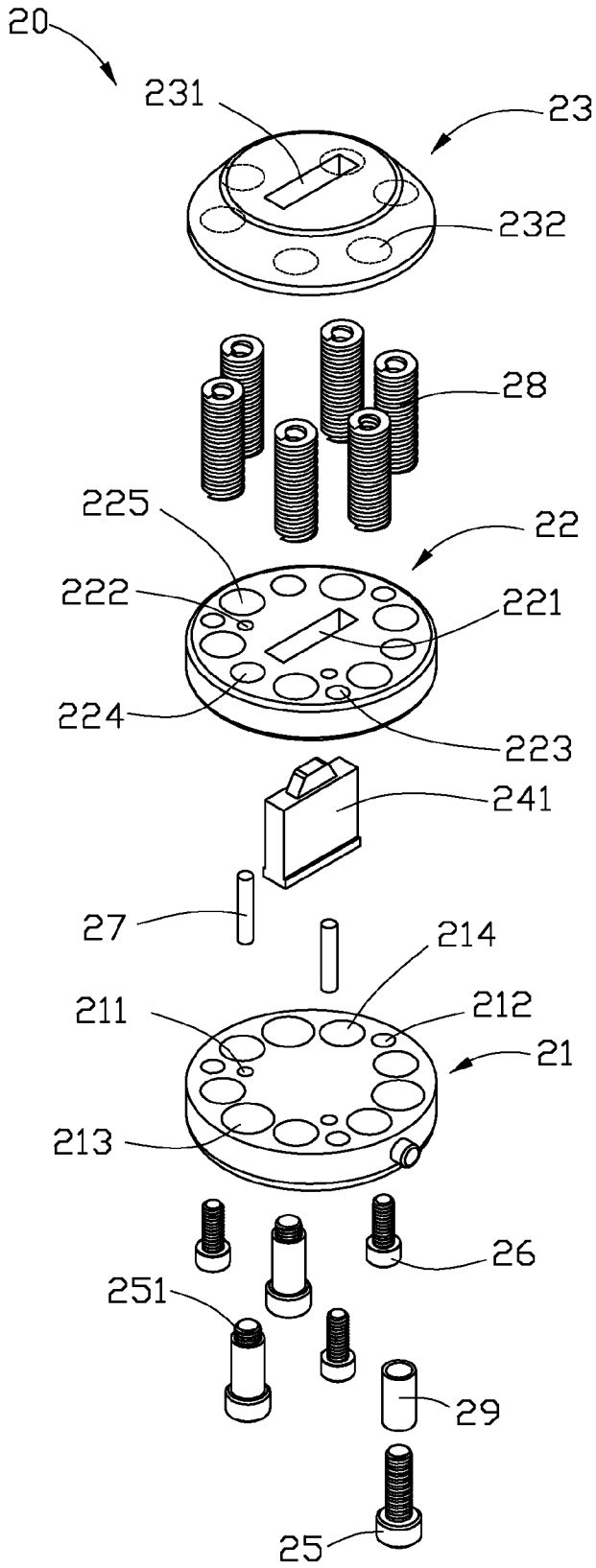
FIG. 2 is an exploded, isometric view of the stamping die in FIG. 1.

Referring to FIG. 2, the stamping die 20 further includes three first screws 25, three second screws 26, two positioning pins 27, six elastic members 28, and three sleeves 29. The positioning pins 27 and the sleeves 29 are configured for positioning the clamping plate 22 on the base set 21. The first and second screws 25, 26 are configured for fixing the clamping plate 22 on the base set 21. The elastic members 28 act as a buffer and are disposed between the clamping plate 22 and the stripper plate 23.

The base set 21 is substantially cylindrical. The base set 21 defines two positioning holes 211, three threaded holes 212, and three through holes 213 in a surface through which the two positioning pins 27, three second screws 26, and three first screws 25 pass, correspondingly. The base set 21 also defines six fixing holes 214 in the surface for correspondingly fixing the six elastic members 28.

The clamping plate 22 is also substantially cylindrical. The clamping plate 22 defines a mounting hole 221 in the center for receiving the first punch 241. The clamp plate 22 also defines two positioning holes 222, three first threaded holes 223, three second threaded holes 224, and six fixing holes 225 in a surface through which the two positioning pins 27, three second screws 26, three first screws 25, and six elastic members 28 pass, correspondingly.

The stripper plate 23, substantially a conical frustum, defines a guide hole 231 in the center through which the first punch 241 passes. The stripper plate 23 also defines six fixing holes 232 in a surface for correspondingly fixing the six elastic members 28.

Figure 3:
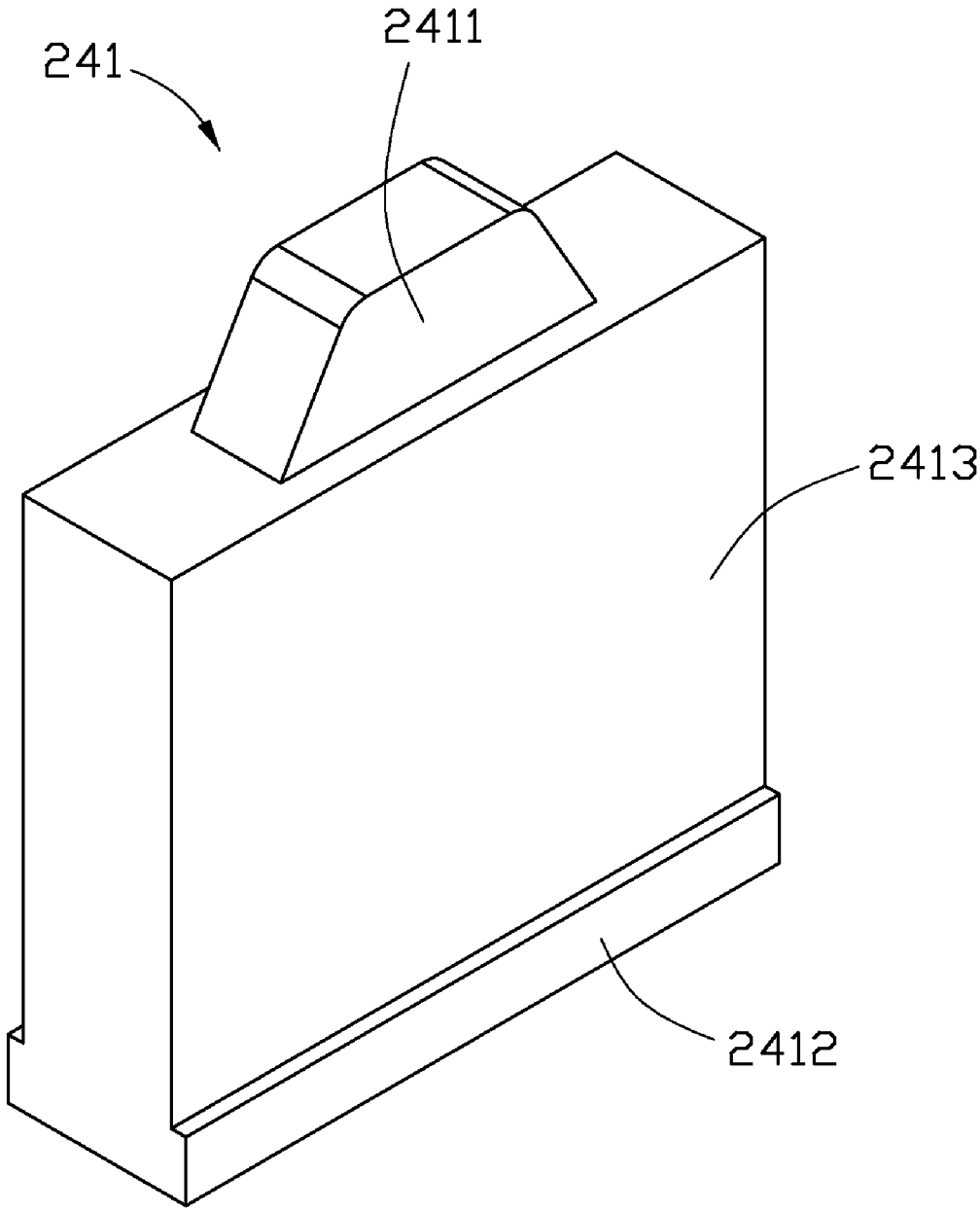
FIG. 3 is an isometric view of a first punch of the stamping die in FIG. 2.

Referring to FIGS. 2 and 3, the first punch 241 includes a main body 2413, a punch head 2411, and two flanges 2412. The main body 2413 is substantially a rectangular block. The punch head 2411 is formed on a top surface of the main body 2413. The punch head 2411 is substantially a convex stage, with a vertical cross-section thereof substantially trapezoidal.

The two flanges 2412 are formed at an end of the main body 2413 away from the punch head 2411, on opposite sides thereof. The punch head 2411 is configured to move in and out of the guide hole 231 of the stripper plate 23.

During assembly of the stamping die 20, the first punch 241 passes through the mounting hole 221 from the bottom surface of the clamping plate 22, and the two flanges 2412 are retained on the bottom of the clamping plate 22, thereby preventing the first punch 241 from separating from the clamp plate 22. The positioning pins 27 enter the positioning holes 211 and 222 for positioning the clamping plate 22 on the base set 21. The sleeves 29 are seated on the first screws 25, and the first screws 25 together with the sleeves 29 enter the through holes 213 of the base set 21, with the screw portions 251 of the first screws 25 threading in the second threaded holes 224 of the clamping plate 22. The second screws 26 thread in the threaded holes 212 of the base set 21 and the first threaded holes 223 of the clamping plate 22. Thus, the clamping plate 22 is assembled on the base set 21 by the screws 25, 26, thereby such that the flanges 2412 of the first punch 241 are clamped firmly between the clamping plate 22 and the base set 21, such that the first punch 241 is assembled on the base set 21. Concurrently, the middle of the elastic member 28 passes through the fixing hole 225 of the clamping plate 22, and two ends of the elastic member 28 are fixed in the fixing hole 214, 232 of the base set 21 and the stripper plate 23, correspondingly.

During disassembly of the stamping die 20, external force withdraws the first and second screws 25, 26 from the base set 21 and the clamping plate 22. The base set 21 and clamping plate 22 are separated, allowing first punch 241 to be detached from the stamping die 20.

During use of the stamping die 20, external force is applied on the base set 21, which then, together with the clamping plate 22, moves upwards. The elastic members 28 compress and impel the stripper plate 23 firmly against a workpiece. Punch head 2411 of the first punch 241 is ejected from the guide hole 231 of the stripper plate 23, and punches a hole in the workpiece. After stamping, external force is withdrawn from the base set 21, and stripper plate 23 and clamping plate 22 separate via elastic members 28, such that the workpiece is detached from the first punch 241 via pushing by the stripper plate 23.

Figure 4:
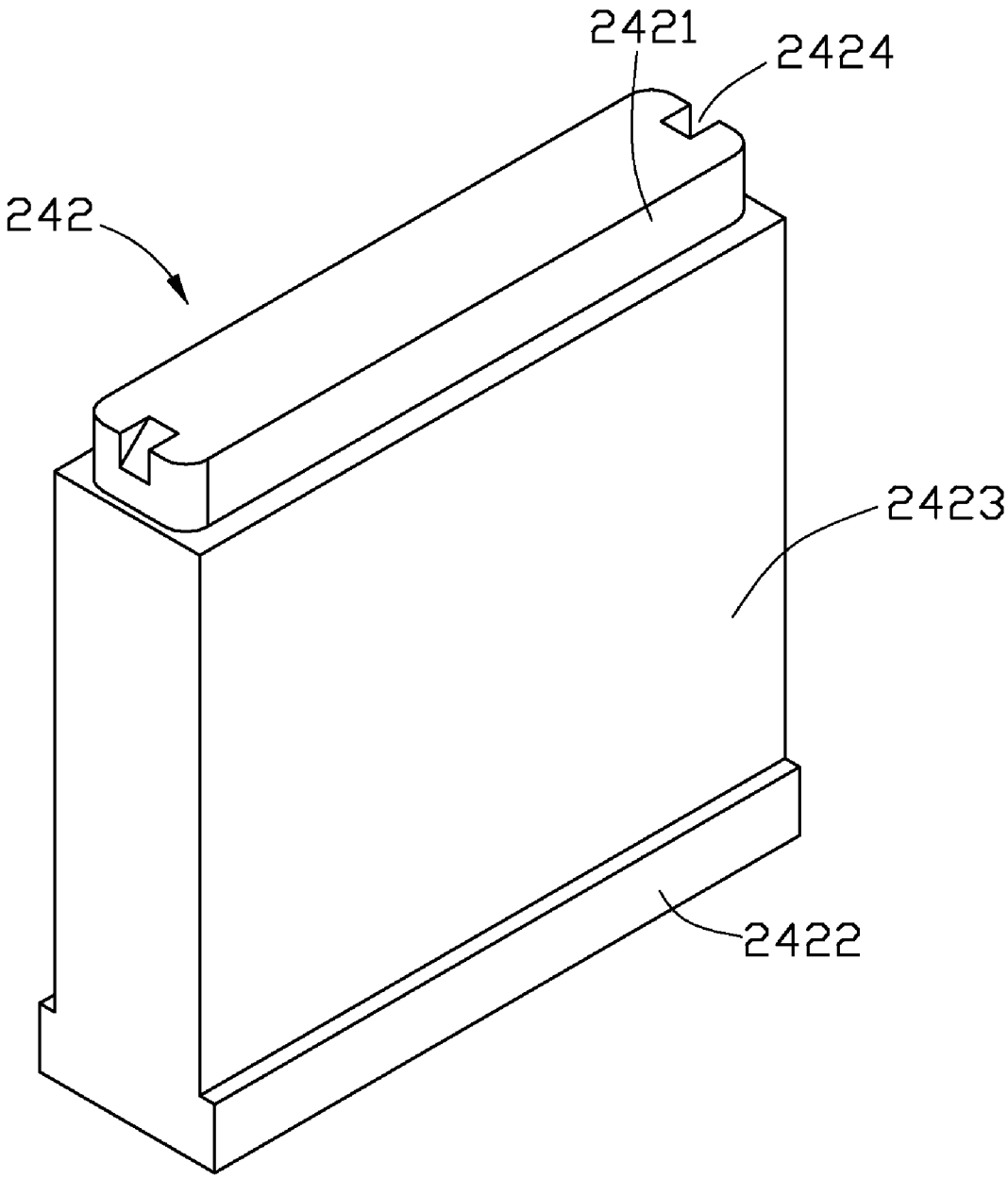
FIG. 4 is an isometric view of a second punch of the stamping die in FIG. 2.

Referring to FIG. 4, the second punch 242 of the stamping die 20 is shown. The second punch 242 is similar to the first punch 241, similarly including a main body 2423, a punch head 2421 and two flanges 2422. The main body 2423 is substantially a rectangular block, on a top surface of which punch head 2421 is formed as a substantially convex stage. The two flanges 2422 are formed at the bottom of the main body 2423, on opposite sides thereof. However, here, two triangular grooves 2424 are further defined on opposite sides of the punch head 2421.

Figure 5:
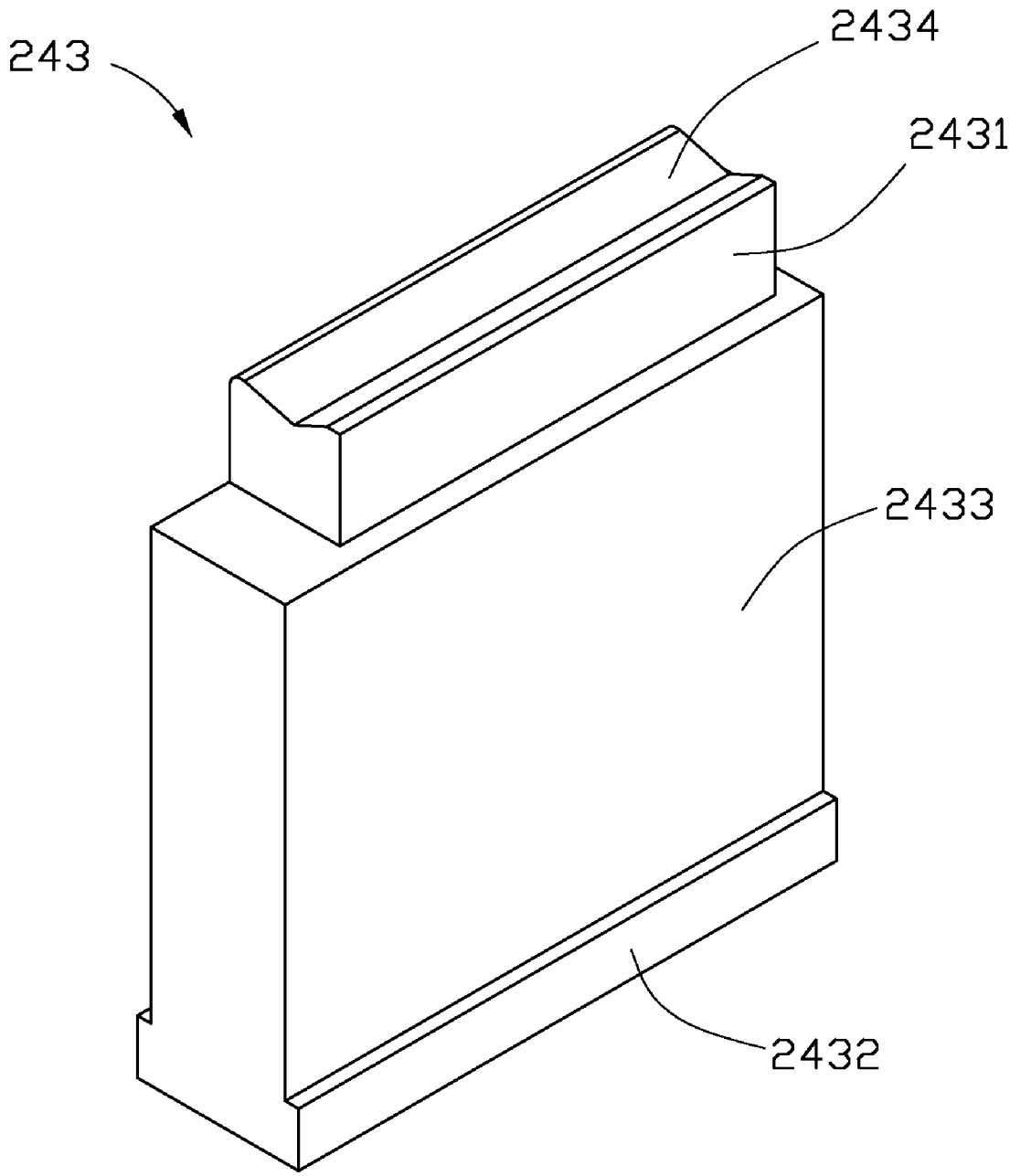
FIG. 5 is an isometric view of a third punch of the stamping die in FIG. 2.

Referring to FIG. 5, the third punch 243 of the stamping die 20 is shown. The third punch 242 is similar to the first punch 241, similarly including a main body 2433, a punch head 2431 and two flanges 2432. The main body 2433 is substantially a rectangular block. The punch head 2431 is formed on a top surface of the main body 2433, and the punch head 2431 is substantially a convex stage. The two flanges 2432 are formed at the bottom of the main body 2433, on opposite sides thereof. However, here, the center of the top surface of the punch head 2431 is depressed, thus forming two connecting inclined planes 2434.

Figure 6:
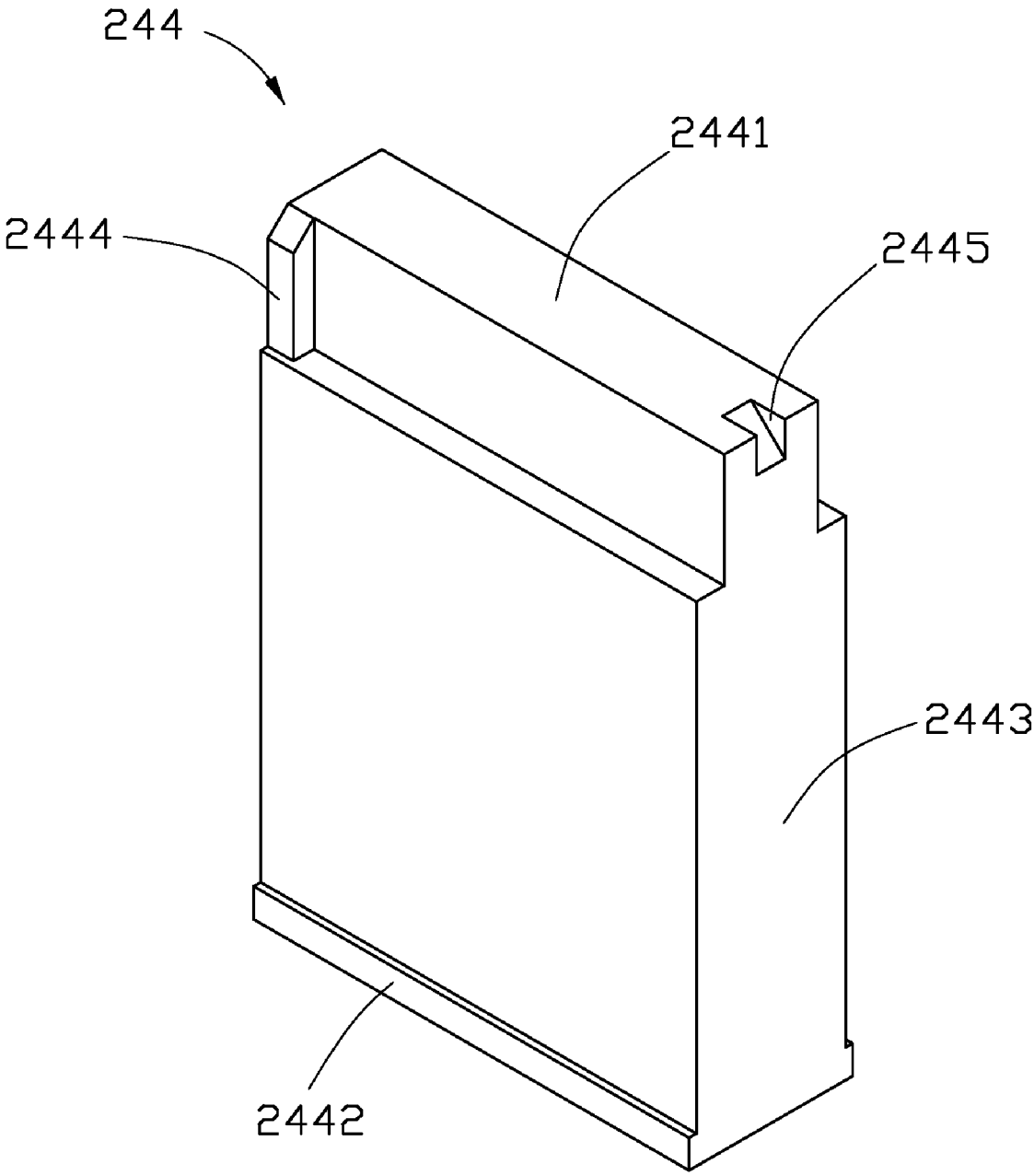
FIG. 6 is an isometric view of a fourth punch of the stamping die in FIG. 2.

Referring to FIG. 6, the fourth punch 244 of the stamping die 20 is shown. The fourth punch 244 is similar to the first punch 241, similarly including a main body 2443, a punch head 2441 and two flanges 2442. The main body 2443 is substantially a rectangular block. The punch head 2441 is formed on a top surface of the main body 2443, and the punch head 2441 is substantially a convex stage. The two flanges 2442 are formed at the bottom of the main body 2443, and on opposite sides of the main body 2443 correspondingly. However, here, two protrusions 2444 are formed on opposite sides of an end of the punch head 2441, and a triangular groove 2445 is defined in a side of another end of the punch head 2441.

Figure 7:
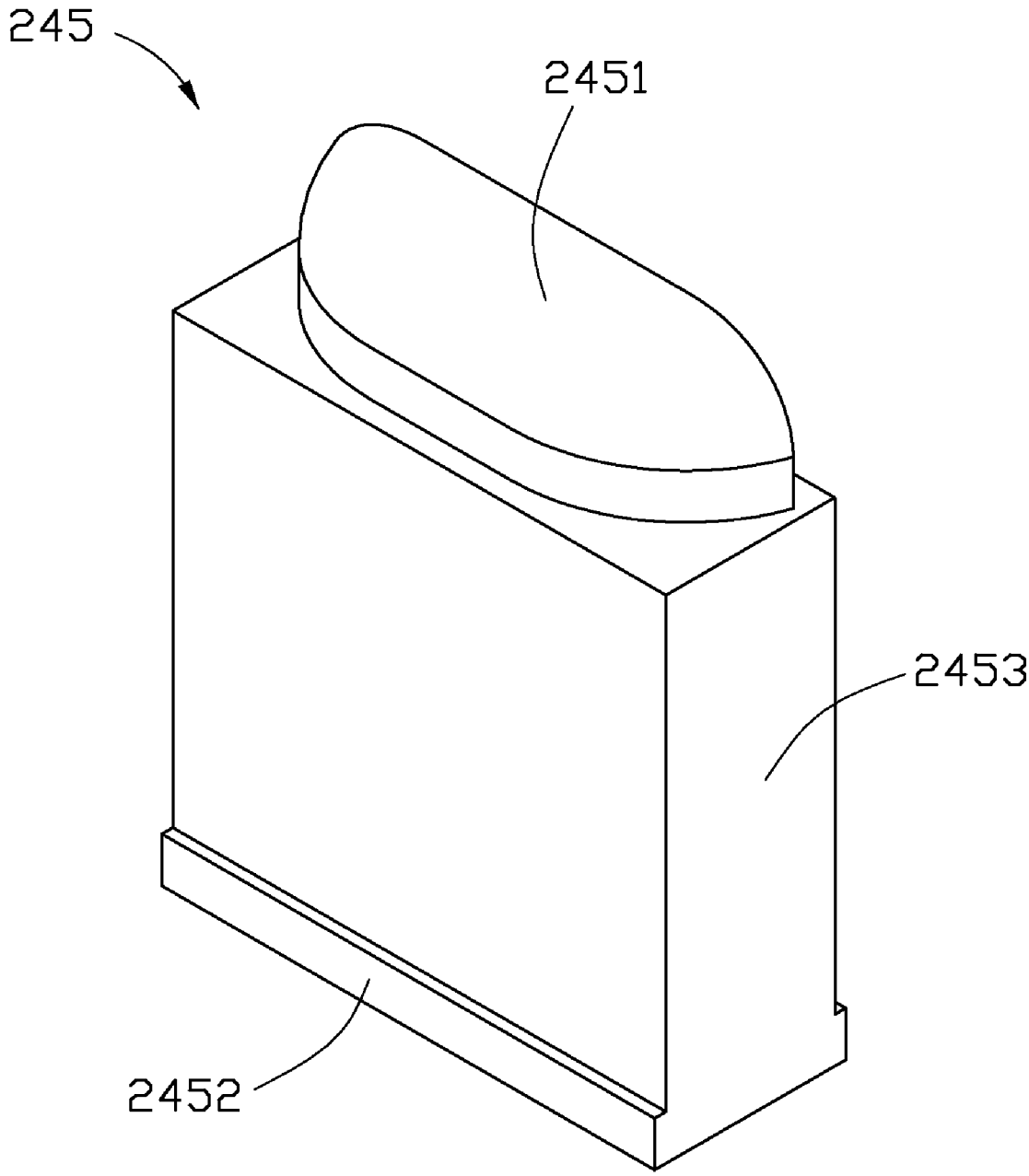
FIG. 7 is an isometric view of a fifth punch of the stamping die in FIG. 2.
Figure 8:
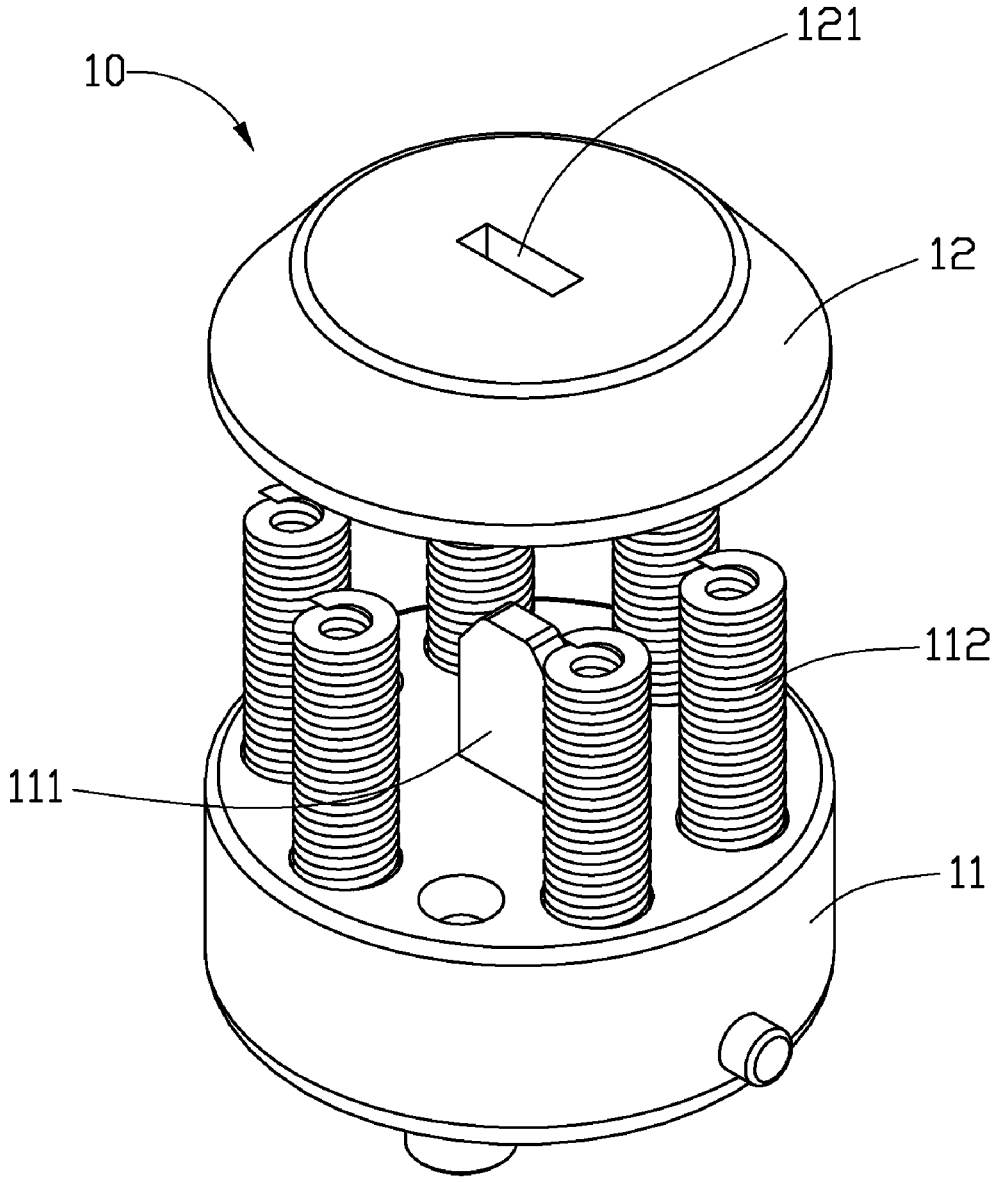
FIG. 8 (RELATED ART)
FIG. 8 is an exploded, isometric view of a conventional stamping die.

Referring to FIG. 7, the fifth punch 245 of the stamping die 20 is shown. The fifth punch 244 is similar to the first punch 241, similarly including a main body 2453, a punch head 2451 and two flanges 2452. The main body 2453 is substantially a rectangular block. The punch head 2451 is formed on a top surface of the main body 2453, and the punch head 2451 is substantially a convex stage. The two flanges 2452 are formed at the bottom of the main body 2453, and on opposite sides of the main body 2453 correspondingly. However, here, a cross-section of the punch head 2451 parallel to a top surface of the punch head 2451 is substantially U-shaped.

Because any of the first punch 241, the second punch 242, the third punch 243, the fourth punch 244, or the fifth punch 245 can be deployed as a standalone member, any of them being detachably assembled in the stamping die 20, different shaped holes can be punched. When a new product requiring a different hole shape is to be produced, rather than the entire stamping die 20 needing replacement, only the punch need be swapped out. In addition, when the punch of the stamping die 20 is worn, only the punch needs to be replaced, reducing production time and costs.

It should be noted that the punches 241, 242, 243, 244, and 245 can be detachably assembled in the stamping die 20 by means other than clamping by the clamping plate 22, such as attachment to the base set 21 via latches, or fixing to the base set 21 via screws, allowing clamping plate 22 to be omitted. The elastic members 28 may be replaced by other elastic members. The number of elastic members 28, first screws 25, second screws 26, and positioning pins 27 may be changed according to practical requirements. In particular, the punch of the stamping die 20, while described and illustrated here, can take various other suitable shapes as required, while remaining well within the scope of this disclosure.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A stamping die comprising:

a base set;

a punch disposed in the stamping die;

a stripper plate disposed on the base set, and a guide hole defined in the stripper plate through which the punch passes;

a clamping plate disposed between the base set and the stripper plate, and at least one elastic member disposed between the clamping plate and the stripper plate;

wherein the punch comprises at least one flange disposed on a side thereof, the clamping plate defines a mounting hole in a surface through which the punch passes, and the at least one flange of the punch is retained at an end of the clamping plate adjacent to the base set; the clamping plate is detachably fixed on the base set, thus the at least one flange of the punch is clamped between the clamping plate and the base set, such that the punch is fixed but detachable from on the base set.

2. The stamping die as claimed in claim 1, wherein the punch comprises a main body and a punch head formed on the top surface thereof the main body, the punch head being substantially a convex stage, with a vertical cross-section thereof being substantially trapezoidal.

3. The stamping die as claimed in claim 1, wherein the punch comprises a main body with a punch head formed on the top surface thereof, the punch head being substantially a convex stage with two triangular grooves defined in opposite sides thereof.

4. The stamping die as claimed in claim 1, wherein the punch comprises a main body and a punch head formed on the top surface thereof, the punch head being substantially a convex stage, with the center of the top surface thereof depressed to form two connecting inclined planes.

5. The stamping die as claimed in claim 1, wherein the punch comprises a main body and a punch head formed on the top surface thereof, the punch head bring substantially a convex stage, with two protrusions formed on opposite sides of an end thereof, and a triangular groove defined in a side of another end thereof.

6. The stamping die as claimed in claim 1, wherein the punch comprises a main body and a punch head formed on the top surface thereof, the punch head being substantially a convex stage, with a cross-section thereof parallel to a top surface thereof being substantially U-shaped.

7. The stamping die as claimed in claim 1, wherein the base set comprises at least one positioning hole defined in a surface thereof, the clamping plate also comprising at least one positioning hole defined in a surface corresponding to the positioning hole of the base set; the stamping die comprising at least one positioning pin, the at least one positioning pin passing into the positioning hole of the base set and the positioning hole of the clamping plate, thus positioning the clamping plate on the base set.

8. The stamping die as claimed in claim 1, wherein the base set comprises a plurality of threaded holes defined in a surface thereof, and wherein the clamping plate also comprises a plurality of threaded holes defined in a surface corresponding to the threaded holes of the base set; the stamping die comprising a plurality of screws received in the threaded holes of the base set and the threaded holes of the clamping plate, detachably fixing the clamping plate on the base set.

9. The stamping die as claimed in claim 1, wherein the base set comprises at least one fixing hole defined in a surface thereof, the clamping plate comprises at least one fixing hole defined in a surface corresponding to the fixing hole of the base set, and the stripper plate also comprises at least one fixing hole defined in a surface corresponding to the fixing hole of the clamping plate.

10. The stamping die as claimed in claim 9, wherein the at least one elastic member is a helical spring, the middle of which passes through the fixing hole of the clamping plate, and two ends of which are fixed in the fixing hole of the base set and the fixing hole of the stripper plate, correspondingly.

11. A stamping die comprising:

a base set;

a punch detachably assembled on the base set;

a stripper plate disposed on the base set, defining a through hole through which the punch passes; and at least one elastic member disposed between the base set and the stripper plate, wherein the base set is substantially cylindrical, defining at least one fixing hole in a surface thereof; the stripper plate is substantially a conical frustum, and defines at least one fixing hole in a surface corresponding to the at least one fixing hole of the base set.

12. The stamping die as claimed in claim 11, wherein the at least one elastic member is a helical spring, with two ends thereof fixed in the fixing hole of the base set and the fixing hole of the stripper plate, correspondingly.

* * * * *